US007334941B2

(12) United States Patent
Fenster

(10) Patent No.: US 7,334,941 B2
(45) Date of Patent: Feb. 26, 2008

(54) APPARATUS AND METHOD FOR WASHING OF ITEMS

(75) Inventor: David S Fenster, Ramsey, NJ (US)

(73) Assignee: Innovative Home Creations Ltd., Monsey, NY (US)

( * ) Notice: Subject to any disclaimer, the term of this patent is extended or adjusted under 35 U.S.C. 154(b) by 626 days.

(21) Appl. No.: 10/788,856

(22) Filed: Feb. 27, 2004

(65) Prior Publication Data

US 2004/0182117 A1 Sep. 23, 2004

Related U.S. Application Data

(60) Provisional application No. 60/451,149, filed on Feb. 28, 2003.

(51) Int. Cl.

| | |
|---|---|
| ***B65D 33/16*** | (2006.01) |
| ***B65D 33/00*** | (2006.01) |
| ***B65D 39/00*** | (2006.01) |
| ***B65D 30/08*** | (2006.01) |
| ***B65D 30/14*** | (2006.01) |
| ***B65D 30/10*** | (2006.01) |
| *B08B 3/00* | (2006.01) |
| *D06F 39/00* | (2006.01) |

(52) U.S. Cl. ..... 383/117; 383/66; 383/97; 383/105; 383/107; 383/112; 383/114; 383/115; 383/119; 383/123; 383/124; 134/34; 8/159

(58) Field of Classification Search ..... 8/159; 383/105, 107, 112, 114, 115, 117, 119, 123, 383/124, 125, 66, 97; 134/34
See application file for complete search history.

(56) References Cited

U.S. PATENT DOCUMENTS

| | | | | |
|---|---|---|---|---|
| 4,974,967 | A * | 12/1990 | Tsuyoshi et al. | 383/97 |
| 5,050,998 | A * | 9/1991 | Wachtel | 383/6 |
| 7,056,023 | B2 * | 6/2006 | Heidel | 383/117 |
| 2004/0264815 | A1 * | 12/2004 | Gibeau | 383/117 |

* cited by examiner

*Primary Examiner*—Michael Barr
*Assistant Examiner*—Rita R Patel
(74) *Attorney, Agent, or Firm*—David Aker

(57) ABSTRACT

An apparatus for washing items comprises a generally cylindrical mesh housing; a first wall and a second wall, said first wall and said second wall being positioned within said housing so as to define first, second and third compartments in said housing; an opening in each of said compartments through which an item to be washed can be placed in or removed from a respective compartment; and a closure device for closing said compartments to retain said items in said compartments when said items are being washed. The first wall and said second wall may each comprise an endless pocket and a stiffener disposed within said pocket. A polymer loop may be used to stiffen said first wall and said second wall. A method of using the apparatus to wash various items, including those of delicate fabrics.

21 Claims, 2 Drawing Sheets

APPARATUS AND METHOD FOR WASHING OF ITEMS

This application claims priority from provisional patent application Ser. No. 60/451,149 filed on Feb. 28, 2003, the entire contents of which are incorporated herein by reference.

BACKGROUND OF THE INVENTION

1. Field of the Invention

The present invention relates to apparatus used for washing of items that may include personal care and delicate items. More particularly, it relates to apparatus used for washing of items that are readily damaged by washing machines, such as personal care items including prosthetic devices and delicate items such as lingerie generally, panties, and in particular, pantyhose and stockings.

2. Prior Art

Very delicate garments, such as items of lingerie, including brassieres, panties and other similar items, can be protected from damage by hand washing. However, with the demands of a busy schedule, this not is generally a viable option.

Many washing machines manufactured today have some settings that may be used for more gentle washing cycles. However, these setting may not be adequately gentle to preserve the shape of delicate fabrics and to prevent other types of damage. Further, it is often desirable to run a full load of various fabrics that need cleaning, and even if a gentle wash cycle is used, the mere presence of a full load of other items, during the various washing cycles, may cause damage to delicate items. Finally delicate and generally expensive items such as prosthetic devices, such as, for example, prosthetic brassieres, need to be carefully handled during machine washing to avoid damage Thus, there is a need for a way to protect the integrity of items during the machine washing process, which provides flexibility in the use of the washing machine in terms of size of load and selected washing cycles.

SUMMARY OF THE INVENTION

It is an object of the invention to provide a device for protecting items while being washed in a washing machine.

It is a further object of the invention to provide a device that does not interfere with the washing process.

It is a further object of the invention to provide a device that is relatively simple to manufacture and low in cost.

These objects and others are achieved in accordance with the invention by an enclosure for items including a cylindrical frame and a flow through mesh on the frame which allows washing water to freely flow to and from the item being washed. Compartments for the item or items to be washed may be closed by a zipper (or other closing device).

In use, the zipper is opened. An item (or a plurality of items), such as, for example, panty hose, a pair of stockings, or one or two panties, is placed in the compartments. The zippers are pulled closed by zipper pulls. The apparatus, including its contents, is placed in the washing machine along with the remainder of the load to be washed. The contents are protected from rough mechanical handling by virtue of being within the apparatus, but are fully washed due to the flow through nature of the mesh. After washing, the contents of the apparatus are removed from the apparatus, and dried in any number of ways well known in the art.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
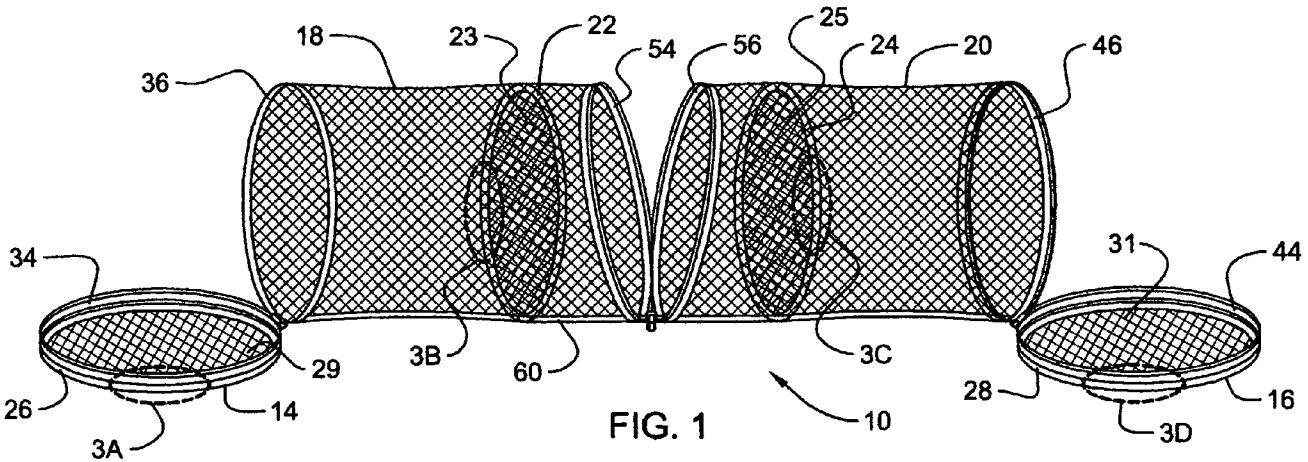
FIG. 1 is a perspective view of an apparatus in accordance with the invention, opened to receive garments.

Referring to FIG. 1, there is shown a front view of an apparatus 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
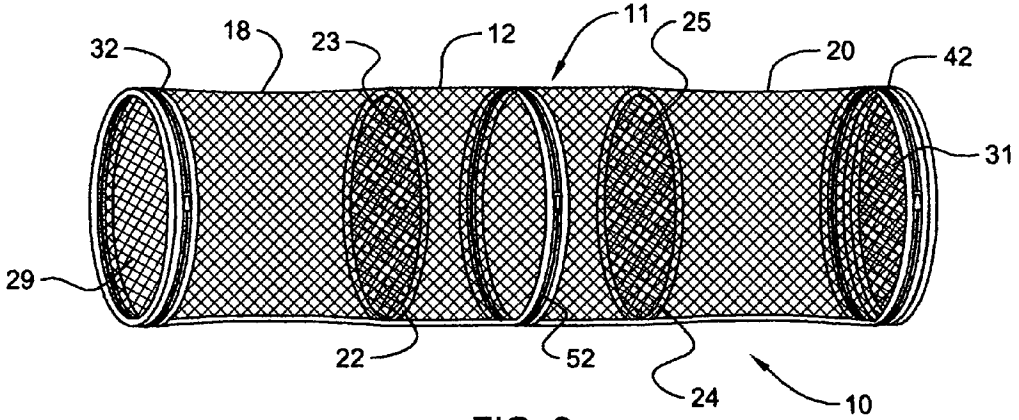
FIG. 2 is a perspective view of the apparatus of FIG. 1, in a closed configuration, ready to wash garments placed therein.

Referring to FIG. 1 and FIG. 2, apparatus 10 comprises a generally cylindrical housing 11 having a mesh covering 12, end panels 14 and 16, and cylindrical sections 18 and 20. The housing 11, end panels 14 and 16, and cylindrical sections 18 and 20 all have walls formed of a fabric mesh material, such as a polyester mesh having a continuous array of closely spaced opening of about 1.0 millimeter in diameter. The resulting structure allows water used to wash and rinse an item, such as a garment, placed within apparatus 10 to flow freely into and from the interior of apparatus 10. This mesh material has a soft texture and is very flexible, thus protecting garments placed within apparatus 10, as well as those external to apparatus 10 which come into contact with the exterior of apparatus 10, during the washing process.

Figure 3B:
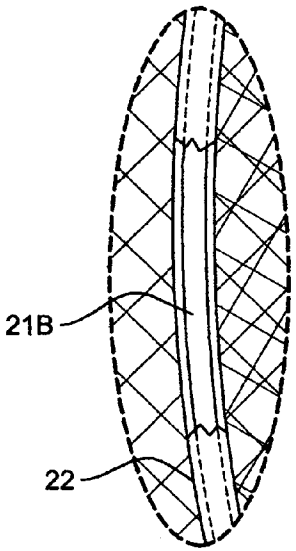
FIGS. 3A, 3B, 3C and 3D are enlarged views of portions 3A, 3B, 3C and 3D of FIG. 1, respectively.

Cylindrical sections 18 and 20 of apparatus 10 are assisted in holding a generally cylindrical shape due to extruded plastic stiffeners formed of a material such as polypropylene, and having a diameter of approximately 1.0 millimeter. A first stiffener 21B (FIG. 3B) is disposed within a first endless fabric pocket 22 sewn about the internal circumference of section 18. A second stiffener 21C (FIG. 3C) is disposed within a second endless fabric pocket 24 sewn about the internal circumference of section 20. The stiffeners do not have to be formed as endless loops, and may be greater in length than the circumference of their respective section 18 and 20 so that there is some overlap of their ends within pocket 22 and 24.

A circular mesh wall 23 is sewn about pocket 22. A circular mesh wall 25 is sewn about pocket 24. The mesh of walls 23 and 25 may be of identical material, which may in turn be identical to the mesh material described above.

Figure 3D:
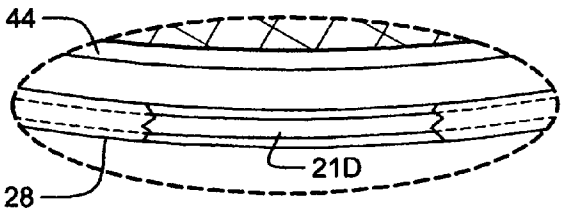
Figure 3A:
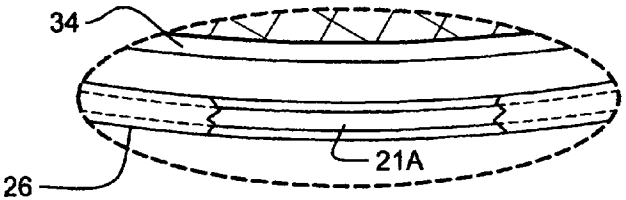
Figure 3C:
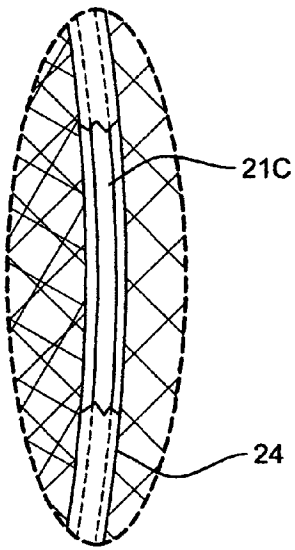

End panels 14 and 16, which are of circular shape, each have a respective pocket 26 and 28 for receiving a respective extruded plastic stiffener, 21A (FIG. 3A) and 21D (FIG. 3D). End panels 14 and 16 have respective circular mesh walls 29 and 31 sewn about their peripheries to pockets 26 and 28.

A first zipper 32, having a first side 34 sewn about the circumference of pocket 26 and a second side 36 sewn about a first circumferential end of section 18, serves to releaseably attach end panel 14 to section 18. When attached, end panel 14, a portion of section 18, and wall 23 form a first compartment into which items to be washed may be placed.

In a similar manner, a second zipper 42, having a first side 44 sewn about the circumference of pocket 28 and a second side 46 sewn about a first circumferential end of section 20, serves to releaseably attach end panel 16 to section 20. When attached, end panel 16, a portion of section 20, and wall 25 form a second compartment into which items to be washed may be placed.

A third zipper 52, having a first side 54 sewn about the second circumferential end of section 18, and a second side 56 sewn about the second circumferential end of section 20, serves to releaseably attach section 18 and section 20. When attached to one another by zipper 52, a portion of section 18, a portion of section 20, wall 23 and wall 25 form a third compartment into which items to be washed may be placed.

End panel 14, section 18, section 20 and end panel 18 are all held together by a folded fabric strip 60 placed in the interior of apparatus 10. Fabric strip 60 is sewn at one end to side 34 of zipper 32, along its length to the mesh wall of section 18 and to the mesh wall of section 20, and at its other end to side 44 of zipper 42. Thus, when zippers 32, 42 and 52 are opened to allow access for the placing of item to be washed within, or removal of items that have been washed, from apparatus 10, end panel 14, section 18, section 20 and end panel 16 remain attached to one another. This permits zippers 32, 42 and 52 to be easily engaged to close the various compartments described above. Further, fabric strip 60 serves as a stop for zippers 32, 42 and 52, assuring that while the various zippered compartments can be opened completely, all of the teeth thereof can not be completely disengaged. By virtue of being sewn so as to be folded, fabric strip 60 encloses both ends of side 34 of zipper 32, and both ends of side 44 of zipper 42. Also by virtue of being sewn so as to be folded, fabric strip 60 encloses the ends of the mesh used to form the walls of section 18 and section 20, by running along the entire length thereof and capturing the ends with its fold.

When the compartments of apparatus 10 contain items to be washed, apparatus 10, due to the stiffeners in their respective pockets, and the presence of the items to be washed, will have the generally cylindrical shape, as described above. However, it has been found desirable that apparatus 10 have a fully extended length of no greater than approximately 18 inches (45.7 cm), and a diameter of approximately 6 inches (15.2 cm). Limiting the length prevents the apparatus from being wound around the agitator of a typical washing machine when apparatus 10 is placed therein for washing garments, and in particular delicate garments such as lingerie.

It is noted that zippers 32, 42 and 52 are preferably configured with meshing plastic teeth, as is well known in the art. Plastic teeth are used to avoid corrosion of the teeth when they are exposed to water and detergents during the washing process. The zipper pulls (not shown) of these zippers are preferably made of a plastic material as well.

In using apparatus 10, garments to be washed, such as delicate panties, or other delicate articles, that should be gently treated to maintain shape and appearance, are inserted into the compartments of apparatus 10. The zippers are then closed by pulling the respective zipper pulls (not shown), so that the compartments of apparatus 10 are closed as shown in FIG. 2. Apparatus 10 may then be placed in a clothes washing machine, and the items or garments contained therein will be washed along with other garments in the washing machine that are not contained within apparatus 10.

After the wash cycles have been completed, apparatus 10 is removed from the washing machine. Zippers 32, 42 and 52 are opened and the garments contained therein are removed and dried in accordance with drying procedures appropriate for items that have been washed.

It will be understood that while the invention has been described primarily with reference to an apparatus or device for washing delicate items, and in particular items of lingerie, such as panty hose and stockings, it may have many other uses. For example prosthetic devices of many kinds may be washed and protected, and this may be done in other environments than in a washing machine (or in a washing machine or other washing environment with water that is significantly hotter than can be used in hand washing). For example, these additional washing environments may include disinfecting or sterilizing apparatus. Items that can be washed within the apparatus in accordance with the invention may include hair pieces, biological waste containers that must worn on the body, and a variety of other personal care items that require periodic washing. In addition, the apparatus in accordance with the invention may be used as a container for industrial or other components or parts that may undergo a washing, disinfecting, or sterilizing process.

Thus, it should be understood that the foregoing description is only illustrative of the invention. Various alternatives and modifications can be devised by those skilled in the art without departing from the invention. For example, although zippers are used, other compartment closing devices, such as fabric fasteners, snaps, or catches of various kinds could also be used. Accordingly, the present invention is intended to embrace all such alternatives, modifications and variances that fall within the scope of the appended claims.

What is claimed is:

1. An apparatus for washing items, comprising:

a generally cylindrical housing having a mesh covering;

a first wall and a second wall, said first wall and said second wall being disposed perpendicularly to a longitudinal axis of said housing, and within said housing, so as to define first, second and third compartments in said housing;

an opening in each of said compartments through which an item to be washed can be placed in or removed from a respective compartment; and a closure device for each of said compartments for closing said compartments to retain said items in said compartments when said items are being washed.

2. The apparatus claim 1, wherein said first wall and said second wall each comprise a polymer loop which stiffens said first wall and said second wall.

3. The apparatus of claim 1, wherein said first wall and said second wall each comprise an endless pocket and a stiffener disposed within said pocket.

4. The apparatus of claim 1, further comprising a circular end panel at each end of said housing, said end panels each having an endless pocket and a stiffener disposed within said pocket.

5. The apparatus of claim 1, wherein said closure device comprises at least one of a zipper, a fabric fastener, a snap or a catch, for each compartment.

6. The apparatus of claim 5, wherein said closure device is a zipper having plastic teeth.

7. The apparatus of claim 1, having a fully extended length of no greater than approximately 18 inches.

8. The apparatus of claim 1, having a diameter of approximately 6 inches.

9. The apparatus of claim 1, wherein said generally cylindrical housing has a first cylindrical portion and a second cylindrical portion, and a closure device for releaseably connecting said first cylindrical portion and said second cylindrical portion.

10. The apparatus of claim 9, further comprising a circular end panel at each end of said housing, said end panels each having an endless pocket and a stiffener disposed within said pocket.

11. The apparatus of claim 10, further comprising a connecting member for connecting a first of said end panels, said first cylindrical portion, said second cylindrical portion, and a second of said end panels.

12. The apparatus of claim 11, wherein said connecting members comprises a fabric.

13. The apparatus of claim 12, wherein said fabric is folded and secured to an inside surface of each of said first end panel, said first cylindrical portion, said second cylindrical portion, and said second end panel.

14. The apparatus of claim 12, wherein fabric comprises a folded strip.

15. The apparatus of claim 14, wherein said folded strip is sewn to an interior portion of each of said first end panel, said first cylindrical portion, said second cylindrical portion, and said second end panel.

16. A method of washing at least one item, utilizing the apparatus of claim 1, the method comprising:

placing the item in at least one compartment of a generally cylindrical apparatus having mesh walls through which water may flow to wash the item;

placing the apparatus in a washing environment;

washing the items in the washing environment;

removing the apparatus from the washing environment;

permitting the item to dry.

17. The method of claim 16, wherein the washing environment is a washing machine.

18. The method of claim 16, wherein the washing environment is a disinfecting or sterilizing environment.

19. The apparatus of claim 1, where said first compartment is disposed at a first end of said housing, said second compartment is disposed at a second end of said housing, and said third compartment is disposed between said first compartment and said second compartment.

20. The apparatus of claim 19, wherein the opening and the closure device of said third compartment extend circumferentially about said housing so as to define a first cylindrical portion of said housing and a second cylindrical portion of said housing.

21. An apparatus for washing items, comprising:

a generally cylindrical housing having a mesh covering;

a first wall and a second wall, said first wall and said second wall being disposed perpendicularly to a longitudinal axis of said housing, and within said housing, so as to define first, second and third compartments in said housing;

an opening in each of said compartments through which an item to be washed can be placed in or removed from a respective compartment;

a closure device for each of said compartments for closing said compartments to retain said items in said compartments when said items are being washed;

a circular end panel at each end of said housing, said end panels each having an endless pocket and a stiffener disposed within said pocket; and a connecting member for connecting a first of said end panels, said first cylindrical portion, said second cylindrical portion, and a second of said end panels, wherein:

said first compartment is disposed at a first end of said housing, said second compartment is disposed at a second end of said housing, and said third compartment is disposed between said first compartment and said second compartment; and the opening and the closure device of said third compartment extend circumferentially about said housing so as to define a first cylindrical portion of said housing and a second cylindrical portion of said housing.

* * * * *